US010822142B2

(12) United States Patent
Zuzak

(10) Patent No.: US 10,822,142 B2
(45) Date of Patent: Nov. 3, 2020

(54) TRANSPORTATION AND INSTALLATION APPARATUS FOR WINDOWS AND DOORS

(71) Applicant: Mel Zuzak, Edmonton (CA)

(72) Inventor: Mel Zuzak, Edmonton (CA)

( * ) Notice: Subject to any disclaimer, the term of this patent is extended or adjusted under 35 U.S.C. 154(b) by 0 days.

(21) Appl. No.: 16/264,067

(22) Filed: Jan. 31, 2019

(65) Prior Publication Data

US 2020/0247580 A1 Aug. 6, 2020

(51) Int. Cl.
*B65D 19/38* (2006.01)
*B65D 19/08* (2006.01)

(52) U.S. Cl.
CPC ..... *B65D 19/385* (2013.01); *B65D 19/08* (2013.01); *B65D 2519/00273* (2013.01); *B65D 2519/00532* (2013.01); *E05Y 2800/696* (2013.01)

(58) Field of Classification Search
CPC ..... B65D 19/44
USPC ..... 108/55.1, 55.3, 55.5
See application file for complete search history.

(56) References Cited

U.S. PATENT DOCUMENTS 3,147,860 A * 9/1964 Kean, Sr. ..... B65D 85/48 206/448
3,193,093 A * 7/1965 Hansen ..... B65G 49/062 206/451
3,438,343 A * 4/1969 McConnell ..... B65D 19/385 108/53.5
3,762,343 A * 10/1973 Thacker ..... B65D 19/38 108/53.3
5,154,310 A * 10/1992 Massey ..... B65D 19/44 108/53.3
5,228,821 A * 7/1993 Gleffe ..... B65D 19/12 414/403
5,259,325 A * 11/1993 Pilger ..... B65D 19/44 108/55.1
5,287,816 A * 2/1994 Jungpeter ..... B65D 19/10 108/55.1
5,388,532 A * 2/1995 Wakano ..... B65D 19/12 108/54.1
5,588,372 A * 12/1996 Kelly ..... B65D 19/385 108/53.1
5,676,066 A * 10/1997 Cavalier ..... B65D 19/44 108/55.1
5,906,165 A * 5/1999 McCorkle, Jr. ..... B65D 19/12 108/53.1

(Continued)

*Primary Examiner* — Jose V Chen
(74) *Attorney, Agent, or Firm* — Gulf Coast Intellectual Property Group

(57) ABSTRACT

An apparatus configured to receive, store and transport windows and doors that is further operable to provide assistance in the installation process. The apparatus includes a frame having a floor support assembly and a floor member superposed thereon. A frame is integrally formed with the floor support assembly and extends upwards therefrom on three sides thereof. The frame consists of four vertical support members and a plurality of horizontal support members. The frame defines the receiving area of the apparatus. Hingedly attached securing members are present on the vertical support members and are operable to assist in the securing of the apparatus during transport. A plurality of tie-down loops are secured to the frame. The floor support assembly is configured to be operably coupled with forks of a forklift. The frame further includes joining members and grooves configured to mateably couple when the apparatus are vertically stacked.

6 Claims, 3 Drawing Sheets

(56) References Cited

U.S. PATENT DOCUMENTS

| | | | | |
|---|---|---|---|---|
| D441,166 | S * | 4/2001 | Bowman | D34/38 |
| 6,279,763 | B1 * | 8/2001 | Bush | A47B 43/00 108/55.1 |
| 7,270,236 | B2 * | 9/2007 | Angeletti | B65D 19/44 206/448 |
| 7,802,526 | B2 * | 9/2010 | Brady | B65D 19/12 108/53.5 |
| 8,261,921 | B2 * | 9/2012 | Anscomb | B65D 19/08 211/175 |
| 9,394,100 | B2 * | 7/2016 | Glover | B65D 19/12 |
| 10,407,209 | B1 * | 9/2019 | Choi | B65D 71/0096 |
| 2005/0188901 | A1 * | 9/2005 | Arai | B65D 19/12 108/53.1 |
| 2011/0192760 | A1 * | 8/2011 | Joubert | B65D 19/12 206/600 |
| 2015/0274359 | A1 * | 10/2015 | Linares | B65D 19/38 108/53.1 |
| 2019/0337718 | A1 * | 11/2019 | Hedley | B65G 1/065 |

* cited by examiner

TRANSPORTATION AND INSTALLATION APPARATUS FOR WINDOWS AND DOORS

FIELD OF THE INVENTION

The present invention relates generally to transportation and installation of windows and/or doors, more specifically but not by way of limitation, an apparatus configured to receive and store a plurality of windows and/or doors and ensure proper transportation thereof and further provide a platform that can be operably coupled to a forklift so as to assist in positioning of an installer and the windows/doors for installation thereof.

BACKGROUND

Windows and doors are manufactured by numerous different organizations and are a part of any new construction whether commercial or residential. Additionally, window replacement is a routine occurrence whether due to age or in order to gain efficiency in the structure by replacing the window type. As is known in the art, most windows are manufactured to order and produced to the specific size or sizes that are needed according to the architectural plans of the structure. Windows and doors present challenges across the spectrum of the supply chain. Subsequent being manufactured, the doors/windows must be stored and then be transported to the designated construction site. As doors and windows are often bulky, storage of the doors/windows creates an issue for warehousing. Existing methods include but are not limited to crating and/or the use of pallets. These current methods create limitations such as but not limited to the inability to vertically stack in some configurations.

Another issue with the supply chain of windows/doors is the management of them ensuing delivery to a construction site up until the installation process. Existing transportation and delivery methods require that the doors/windows must be unpacked at the job site and individually moved to either a temporary storage area or proximate the area of the building in which they will be installed. Furthermore, if the windows/doors are to be installed on a floor above ground level this can create even more logistics challenges. All of the aforementioned challenges in the supply chain for windows/doors results in increased costs and deficiencies.

Accordingly, there is a need for a window/door transportation and installation apparatus that is configured to promote efficient packing, storing, shipping and installation of windows and/or doors.

SUMMARY OF THE INVENTION

It is the object of the present invention to provide an apparatus configured to provide packing, storing, shipping and installation of windows and/or doors wherein the present invention includes a frame defining a receiving area.

Another object of the present invention is to provide an apparatus configured to assist in efficient management of the supply chain of windows and/or doors wherein the frame includes vertical support member and horizontal support members defining the receiving area thereof.

A further object of the present invention is to provide an apparatus configured to provide packing, storing, shipping and installation of windows and/or doors wherein the receiving area includes a floor member and wherein the floor member is superposed a floor support assembly.

An additional object of the present invention is to provide an apparatus configured to assist in efficient management of the supply chain of windows and/or doors wherein the floor support assembly includes at least two channels having hollow passages and opening so as to be engage by forks of a forklift.

Yet another object of the present invention is to provide an apparatus configured to provide packing, storing, shipping and installation of windows and/or doors that further includes hingable securing members that are secured to the vertical support members and operable to provide securing assistance during transportation of the present invention.

Still a further object of the present invention is to provide an apparatus configured to assist in efficient management of the supply chain of windows and/or doors that further includes a plurality of transportation tie down loop members.

A further object of the present invention is to provide an apparatus configured to provide packing, storing, shipping and installation of windows and/or doors that further include keepers that are configured to receive a safety line for an installer engaged on the present invention.

An additional object of the present invention is to provide an apparatus configured to assist in efficient management of the supply chain of windows and/or doors wherein the present invention is configured to receive an installer in the receiving area and wherein the apparatus is liftable to a desired installation location via a forklift or other mechanical assistance.

Still a further object of the present invention is to provide an apparatus configured to provide packing, storing, shipping and installation of windows wherein the frame includes opposing top rail members that are configured to assist in the secure vertical stacking of at least two apparatus.

Yet another object of the present invention is to provide an apparatus configured to assist in efficient management of the supply chain of windows and/or doors wherein the bottom of the frame is configured to mateably engage with the opposing top rail members during vertical stacking of the present invention.

An additional object of the present invention is to provide an apparatus configured to provide packing, storing, shipping and installation of windows wherein the present invention further includes a kick plate circumferentially disposed around the floor member.

Another object of the present invention is to provide an apparatus configured to assist in efficient management of the supply chain of windows and/or doors wherein the present invention further includes a GPS module for tracking thereof.

Yet another object of the present invention is to provide an apparatus configured to provide packing, storing, shipping and installation of windows wherein the floor support assembly further includes locking pins to assist in securing to forks of a forklift.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
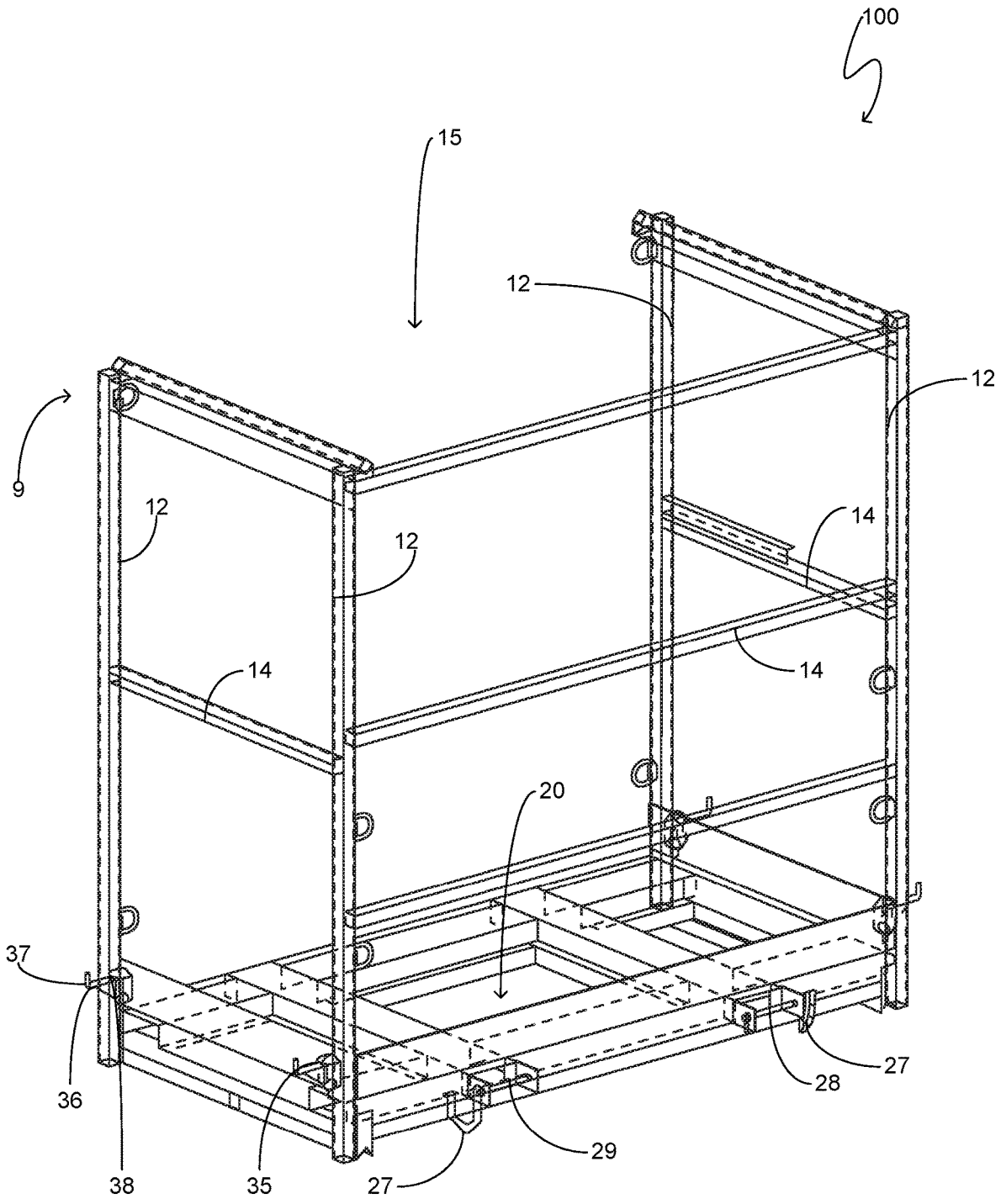
FIG. 1 is a front perspective view of a preferred embodiment of the present invention.
Figure 2:
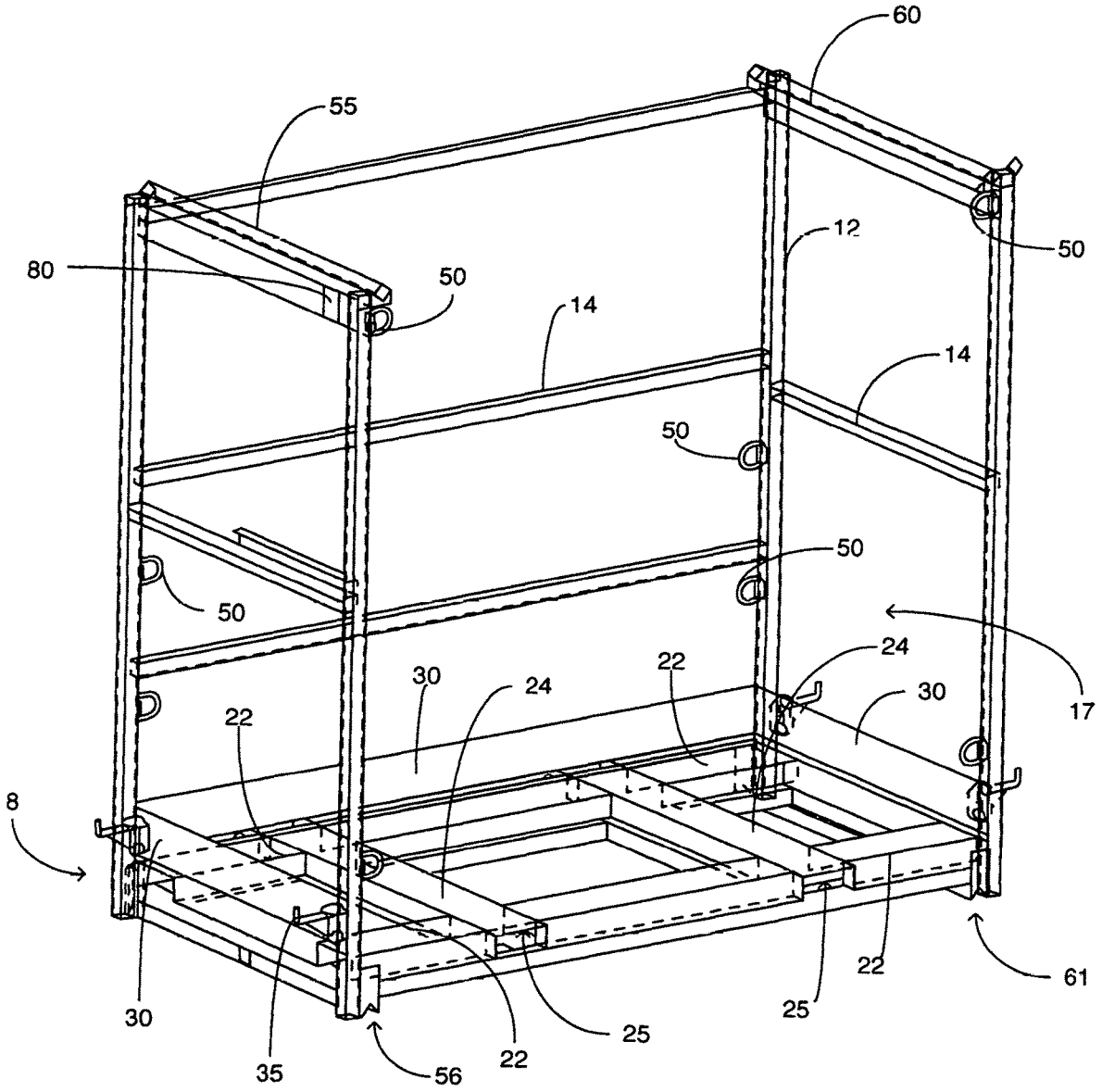
FIG. 2 is a rear perspective view of the present invention.
Figure 3:
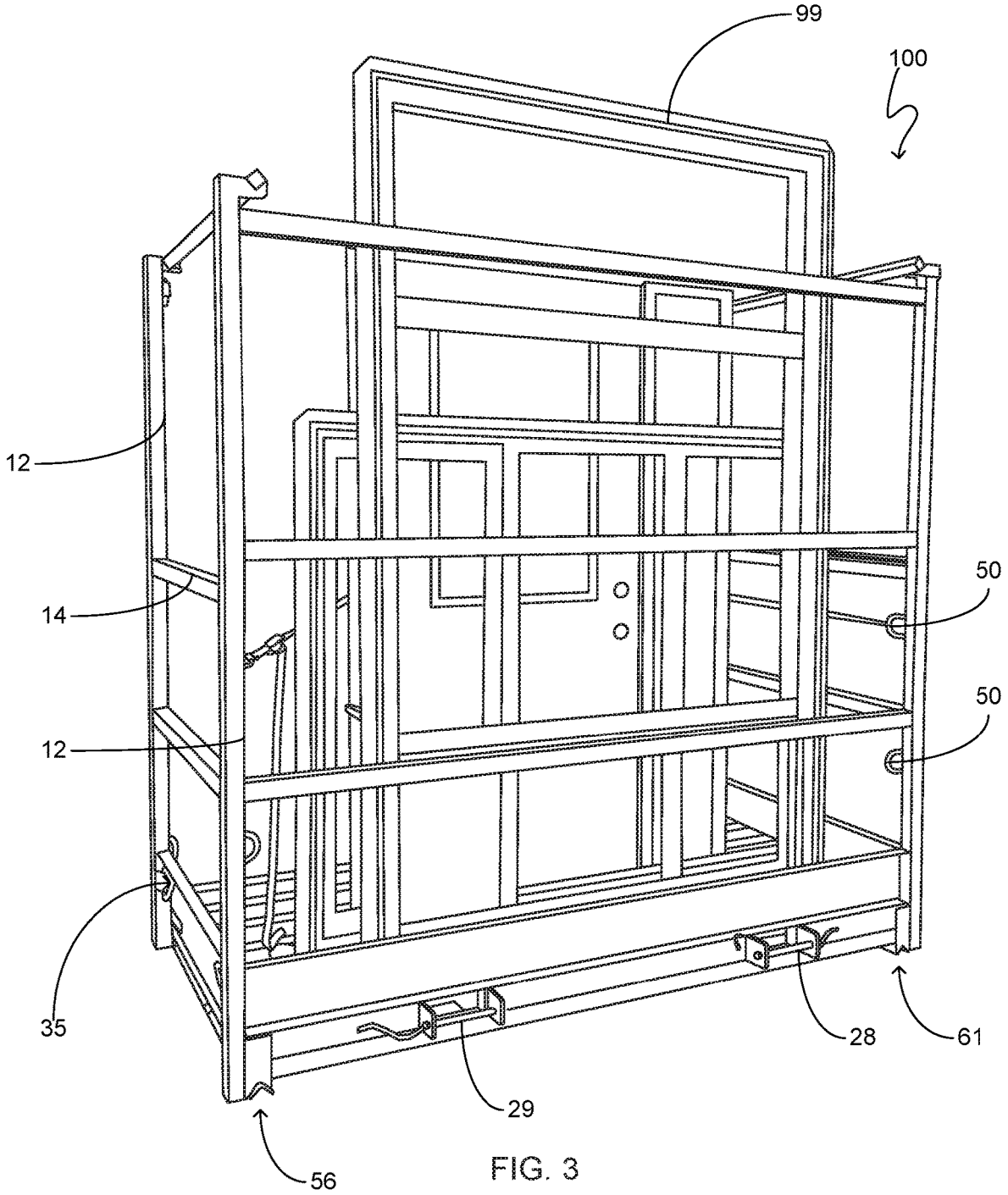
FIG. 3 is a front perspective view of the present invention having exemplary windows and doors in the receiving area thereof.

Referring now to the drawings submitted herewith, wherein various elements depicted therein are not necessarily drawn to scale and wherein through the views and figures like elements are referenced with identical reference numerals, there is illustrated a window and door transportation and installation apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the figures submitted as a part hereof, the window and door transportation and installation apparatus 100 further includes a frame 10. The frame 10 is manufactured from a suitable rigid material such as but not limited to square metal tubing. The frame 10 includes a plurality of vertical support members 12 and horizontal support members 14 that define a receiving area 15. The vertical support members 12 and horizontal support members 14 are operably secured to each other utilizing suitable techniques such as but not limited to welding and/or mechanical fasteners. The vertical support members 12 and horizontal support members 14 are configured in a manner so as to define an opening 17 that provides access to the receiving area 15. The opening 17 is substantially the width of the frame 10 and facilitates the placement access for exemplary doors and/or windows 99 to be placed in the receiving area 15. In the preferred embodiment of the present invention, the frame 10 includes four vertical support members 12 defining the corners of the frame 10. While the embodiment illustrated herein shows four horizontal support members 14, it is contemplated within the scope of the present invention that the frame 10 could have more or less than four horizontal support members 14.

Proximate the lower end 8 of the frame 10 is the floor support assembly 20. The floor support assembly 20 is integrally secured to the vertical support members 12 utilizing suitable durable techniques. The floor support assembly 20 includes lateral support members 22 and longitudinal support members 24 arranged in a configuration so as to support a floor member (not illustrated herein). The floor support assembly 20 is constructed to provide the necessary load support for both a plurality of exemplary doors and/or windows 99 and further provide the necessary support for a user that is engaged in installation of the doors and/or windows. The lateral support members 22 and longitudinal support members 24 are manufactured from materials such as but not limited to metal tubing and are operably secured to each other utilizing suitable techniques. The longitudinal support members 24 are constructed so as to have a hollow passage 25 therethrough. The hollow passage 25 is configured so as to have journaled thereinto at least a portion of a fork of a conventional forklift. The longitudinal support members 24 are arranged with the appropriate lateral spacing so as to receive opposing forks of a forklift thereinto so as to enable the window and door transportation and installation apparatus 100 to be lifted and transported by a forklift.

The longitudinal support members 24 are further equipped with locking pins 28, 29 that extend across the hollow passage 25. The locking pins 28, 29 function to secure a fork of a forklift within the hollow passage 25 so as to inhibit the ability for the fork to move subsequent insertion into the hollow passage 25 of the longitudinal support members 24. Locking pins 28, 29 are releasably secured utilizing chain 27. While a specific quantity of lateral support members 22 and longitudinal support members 24 are illustrated herein for construction of the floor support assembly 20, it is contemplated within the scope of the present invention that alternate configurations and quantities of the lateral support members 22 and longitudinal support members 24 could be implemented in order to construct the floor support assembly 20.

Extending upward from the floor support assembly 20 is the kick plate member 30. The kick plate member 30 is manufactured from a suitable material such as but not limited to metal plate and is configured to be present on three sides of the receiving area 15. It is contemplated within the scope of the present invention that the kick plate member 30 could extend upward at alternate heights. The kick plate member 30 inhibits objects from rolling off the floor and further provides additional security for an individual superposed on the floor of the receiving area 30. While a floor is not specifically illustrate herein, it should be understood within the scope of the present invention that a floor member is superposed the floor support assembly 20 and could be manufactured from a suitable material such as but not limited to metal or wood. It is further contemplated within the scope of the present invention that the floor member could have non-slip material disposed on the surface thereof.

Secured to each of the vertical support members 12 are securing members 35. The securing members 35 are hingedly secured to the vertical support members 12 so as to facilitate movement from a first position to a second position. In the first position, the securing members 35 are positioned so as to be adjacent to the kick plate member 30. In the first position, the securing members 35 are positioned so as to not interfere with loading of the window and door transportation and installation apparatus 100 into a cargo trailer or similar trailer having sides and conventional width and wherein a side by side loading may be desirable. In the second position (illustrated herein) the securing members 35 are moved so as to extend perpendicularly outward from the vertical support members 12. In the second position the securing members 35 are operable to receive a strap or similar tie-down so as to facilitate securing of the window and door transportation and installation apparatus 100 onto a flat bed style trailer. The securing member 35 includes top bar 36 and end bar 37 integrally formed to create an l-shape which ensures maintenance of engagement of a strap with the top bar 36 as end bar inhibits the ability for a strap placed on the top bar 36 to slide off. The securing member 35 further includes support brace 38 wherein the support brace 38 is triangular in shape. The support brace 38 ensures the ability for the securing member 35 to accommodate the load force from a tie-down strap. While four securing members 35 are illustrated herein, it is contemplated within the scope of the present invention that the window and door transportation and installation apparatus 100 could have more or less than four securing members 35.

A plurality of tie-down loops 50 are secured in various positions on the window and door transportation and installation apparatus 100. Depending upon the position of the tie-down loops 50 precipitates the expected use thereof. The tie-down loops 50 are manufactured from a suitable material such as but not limited to metal. The tie-down loops 50 are secured to the frame 10 utilizing suitable durable techniques such as but not limited to welding. By way of example but not limitation, exemplary utilization of the tie-down loops 50 are as follows. Tie-down loops proximate the upper end 9 of the frame 10 could be utilized by an installer present in the receiving area 15 wherein the installer could engage a safety line with at least one of the tie-down loops 50. Another example of utilization of the tie-down loops 50 but not by way of limitation, tie-down loops 50 proximate the bottom end 8 of the frame 10 could receive straps therethrough for scenarios when the window and door transportation and installation apparatus 100 are arranged in a vertical stack. It is contemplated within the scope of the present invention that the window and door transportation and installation apparatus 100 could have various quantities of tie-down loops 50 and provide alternate functions for users.

The frame 10 includes opposing joining members 55,60 secured proximate the upper end 9 of the frame 10. Joining members 55, 60 are manufactured from a suitable material such as but not limited to square metal tubing. The joining members 55, 60 are positioned so as to present an apex wherein the apex is configured to mateably engage with bottom grooves 56, 61. The joining members 55,60 are configured to mateably engage with grooves 56,61 during vertical stacking of two window and door transportation and installation apparatus 100. The joining member 55,60 coupled with the grooves 56,61 are operable to inhibit lateral movement between two stacked window and door transportation and installation apparatus 100 and ensure stability of the vertically stacked configuration.

A GPS module 80 is present on the frame 10. While the GPS module 80 is illustrated in a particular location, it is contemplated within the scope of the present invention that the GPS module 80 could be located in various positions on the frame 10. The GPS module 80 is a conventional GPS module and is configured to provide geolocation of the window and door transportation and installation apparatus 100. The GPS module 80 is configured to provide functions such as but not limited to: tracking of the window and door transportation and installation apparatus 100 during shipping, maintaining the location data of the window and door transportation and installation apparatus 100 once delivered to a job site and identifying when a window and door transportation and installation apparatus 100 is ready for pick up.

It is contemplated within the scope of the present invention that the frame 10 could be manufactured of alternate widths and/or heights. Furthermore, it is contemplated within the scope of the present invention that the frame 10 could further include a sign board having various indicating indicia thereon.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An apparatus configured to receive, store and transport windows and doors wherein the apparatus comprises:

a frame, said frame having four vertical support members defining corners of the frame, said four vertical support members having a lower end and an upper end, said frame having a plurality of horizontal support members, said plurality of horizontal support members being operably coupled intermediate said four vertical support members, said four vertical support members and said horizontal support members defining three sides of said frame, said frame configured to define a receiving area, said frame having an opening providing access to said receiving area, said frame having a bottom end and an upper end, said frame further having a kick plate member, said kick plate member being proximate the bottom end, said kick plate member being present on the three sides of the frame;

a floor support assembly, said floor support assembly being formed at said bottom end of said frame, said floor support assembly having a floor member superposed thereon, said floor support assembly having two longitudinal support members, said floor support assembly having a plurality of lateral support members;

a plurality of securing members, said plurality of securing members being secured to said four vertical support members proximate the lower end of said four vertical support members, said plurality of securing members having a top bar and an end bar formed in an l-shape, said plurality of securing members having a first position and a second position;

a plurality of tie-down loops, said plurality of tie-down loops operably coupled to said frame, said plurality of tie-down straps being proximate the upper end and the bottom end of said frame; and wherein the two longitudinal support members of the floor support assembly are configured in a parallel manner and have a hollow passage therethrough so as to be coupled to forks of a forklift.

2. The apparatus configured to receive, store and transport windows and doors as recited in claim 1, wherein in said first position said plurality of securing members are adjacent said kick plate member.

3. The apparatus configured to receive, store and transport windows and doors as recited in claim 2, wherein in said second position said plurality of securing members extend outward from said four vertical support members so as to engage with a tie-down strap.

4. The apparatus configured to receive, store and transport windows and doors as recited in claim 3, wherein said two longitudinal support members further include locking pins operable to releasably secure forks of a forklift.

5. The apparatus configured to receive, store and transport windows and doors as recited in claim 4, and further including a pair of joining members, said pair of joining members being mounted on opposing sides of the frame proximate the upper end thereof.

6. The apparatus configured to receive, store and transport windows and doors as recited in claim 5 and further including a pair of grooves, said grooves being proximate the bottom end of said frame, said grooves configured to engage said pair of joining members upon two window and door transportation and installation apparatus being arranged in a vertical stack.

* * * * *